US005732769A

United States Patent [19]

Staffa

[11] Patent Number: 5,732,769

[45] Date of Patent: Mar. 31, 1998

[54] DOUBLE-PIPE HEAT EXCHANGER AND PROCESS FOR MANUFACTURING SAME

[75] Inventor: Karl-Heinz Staffa, Stuttgart, Germany

[73] Assignee: Behr GmbH & Co., Stuttgart, Germany

[21] Appl. No.: 610,937

[22] Filed: Mar. 5, 1996

[30] Foreign Application Priority Data

Mar. 17, 1995 [DE] Germany ..... 195 09 788.2

[51] Int. Cl.[6] ..... F28D 7/10

[52] U.S. Cl. ..... 165/154; 165/916

[58] Field of Search ..... 165/154, 155, 165/140, 916

[56] References Cited

U.S. PATENT DOCUMENTS

| | | | |
|---|---|---|---|
| 2,752,128 | 6/1956 | Dedo | 165/154 |
| 3,001,767 | 9/1961 | Straubing | 165/154 |
| 3,323,586 | 6/1967 | Burne et al. | 165/154 |
| 3,339,260 | 9/1967 | Burne et al. . | |
| 3,831,671 | 8/1974 | Was | 165/154 |
| 3,831,672 | 8/1974 | Battisti | 165/154 |
| 4,373,578 | 2/1983 | Saperstein et al. | 165/141 |
| 5,107,922 | 4/1992 | So . | |

FOREIGN PATENT DOCUMENTS

| | | |
|---|---|---|
| 0602968A1 | 6/1994 | European Pat. Off. . |
| 2 592 147 | 6/1987 | France . |
| 2612416A1 | 10/1976 | Germany . |
| 2903805A1 | 8/1979 | Germany . |
| 3021240A1 | 2/1981 | Germany . |
| 3133756A1 | 7/1982 | Germany . |
| 3525168A1 | 2/1986 | Germany . |
| 3602891A1 | 8/1987 | Germany . |
| 3912534C2 | 10/1990 | Germany . |
| 9318913 U | 3/1994 | Germany . |
| 4330214A1 | 3/1995 | Germany . |

*Primary Examiner*—Allen J. Flanigan

*Attorney, Agent, or Firm*—Evenson McKeown Edwards & Lenahan, PLLC

[57] ABSTRACT

A surrounding bead-type collar is pressed out from the pipe material or aat least one of two pipes forming a double-pipe heat exchanger. The radial height of the collars corresponds to the difference of the radii of the interior wall of the exterior pipe and of the exterior wall of the interior pipe. The collars form axial ends of an annular flow space of a completed heat exchanger. The thus constructed pipes with collars may be slid axially and thereby mounted on one another during manufacturing. Before this mounting operation, they are plated with a Nocolok fluxing agent and are subsequently soldered together in a heating step.

26 Claims, 2 Drawing Sheets

DOUBLE-PIPE HEAT EXCHANGER AND PROCESS FOR MANUFACTURING SAME

BACKGROUND AND SUMMARY OF THE INVENTION

This invention relates to a double-pipe heat exchanger, consisting of two pipes, particularly made of aluminum, which are coaxially fitted into one another and are tightly connected with one another on their ends for forming a flow duct situated between them, a turbulence insert being optionally inserted into the flow duct, as well as to a process for manufacturing the double-pipe heat exchanger.

Double-pipe heat exchangers of this type are known. Thus German Patent Document DE-OS 30 21 240, for example, illustrates a double-pipe heat exchanger which consists of stainless steel and, in the case of which, the two steel pipes are connected with one another on their ends by means of a fusion welding process. For this purpose, the interior pipe is widened in its end area, specifically to such an extent that the widened portion of the interior pipe extends along a specified length in parallel to the exterior pipe. The welding takes place in this area. A turbulence insert is situated between the two pipes. The manufacturing of this double-pipe heat exchanger is such that, after the mounting on the connection pieces on the exterior pipe by means of a projection welding process, the two pipes are slid into one another in a spaced manner by means of a device, after which the ends of the interior pipe are widened by the application of pressure to such an extent that they rest against the exterior pipe for the purpose of the welded connection. Such a manufacturing method results in relatively high expenditures.

From German Patent Document DE-OS 26 12 416, a similarly constructed double-pipe heat exchanger is known in the case of which the ends of the interior pipe are also bent open toward the outside for the purpose of the welded connection until they rest on the exterior pipe.

In a different construction according to German Patent Document DE 39 12 534 A1, the ends of the exterior pipe are pulled in so far that they can be fastened on the interior pipe by means of an inert gas shielded arc welding process. However, also in the case of this type of construction, a coaxial alignment of the two pipes is required first. Mainly, there is the risk of corrosion of the weld seams unless a relatively high-expenditure, corrosion-resistant starting material is provided.

Finally, from German Patent Document DE 31 33 756 C2, a construction of a double-pipe heat exchanger, is known which has two coaxial pipes and a turbulence insert arranged between them and in the case of which both pipes, by means of a connection piece which can be fitted onto the front side, are held at a distance and are sealed off with respect to one another. This type of construction does not require a welding operation but the manufacturing and mounting of a relatively high-expenditure fit-on end piece.

It is an object of the invention to suggest a double-pipe heat exchanger of the initially mentioned type and a process for manufacturing same, which are particularly suitable for the use of aluminum as the initial material, make a high-expenditure mounting operation unnecessary and also avoid the danger of corrosion.

For achieving a part of this object, a double-pipe heat exchanger of the initially mentioned type is suggested in the case of which, on both ends of the pipes, at least one surrounding bead-type collar is provided which projects from at least one of the pipes, the height of the collar corresponding to the difference of the radii of the interior wall of the exterior pipe and of the exterior wall of the interior pipe and in the case of which the collars are sealingly soldered to the pipe wall against which they rest. As a result of this development, the two pipes must only be slid axially over one another, the required annulus between the pipes forming already during this operation. A separate alignment is not necessary because the collars take over this alignment. At the same time, the collars are used for the tight soldered connection. In this case, according to the process provided according to the invention which will be explained later, the so-called Nocolok soldering process is expediently used (see *SAE Technical Paper Series*, Claydon and Sugihara, "Brazing Aluminum Automotive Heat Exchanger Assemblies Using a Non-Corrosive Flux Process", International Congress & Exposition Detroit USA, Feb. 28 to Mar. 4, 1983), in which a fluxing medium is used which does not corrode after the soldering and whose residues therefore do not have to be removed. It is necessary that at least one of the pipes to be fitted together later consists of a suitable solder-plated material and is provided with Nocolok fluxing agent at the points to be soldered together. Either both pipes or only one can be plated correspondingly. It is also possible to plate the turbulence insert.

As a further development of the invention, each bead-type collar can be pressed out of the material of the pipe just in front of its end in the manner of a surrounding bead. It is also contemplated according to certain preferred embodiments that each pipe is provided with a bead only on one end, in which case the beads will then be situated opposite one another when the pipes are fitted into one another and will enclose the flow duct between them. However, it is also contemplated to provide only one pipe with two beads and to leave the other pipe smooth. For forming the beads, a roller-burnishing is also contemplated.

For the manufacturing of a double-pipe heat exchanger of the previously mentioned type, a process was found to be particularly advantageous in the case of which, on at least one of the pipes, first in the area of the ends, collar-type beads are pressed out of the pipe material; then at least one of the pipes before or after the pressing out of the beads or optionally also the turbulence insert is acted upon by a Nocolok fluxing agent; then the two pipes are slid over one another and are held at a distance by the beads after which the pipes which are held against one another in this manner are heated for the purpose of the soldered connection.

The new double-pipe heat exchanger is particularly suitable as an oil cooler for the installation into a radiator tank of a radiator for a motor vehicle engine.

Other objects, advantages and novel features of the present invention will become apparent from the following detailed description of the invention when considered in conjunction with the accompanying drawings.

DETAILED DESCRIPTION OF THE DRAWINGS

Figure 1:
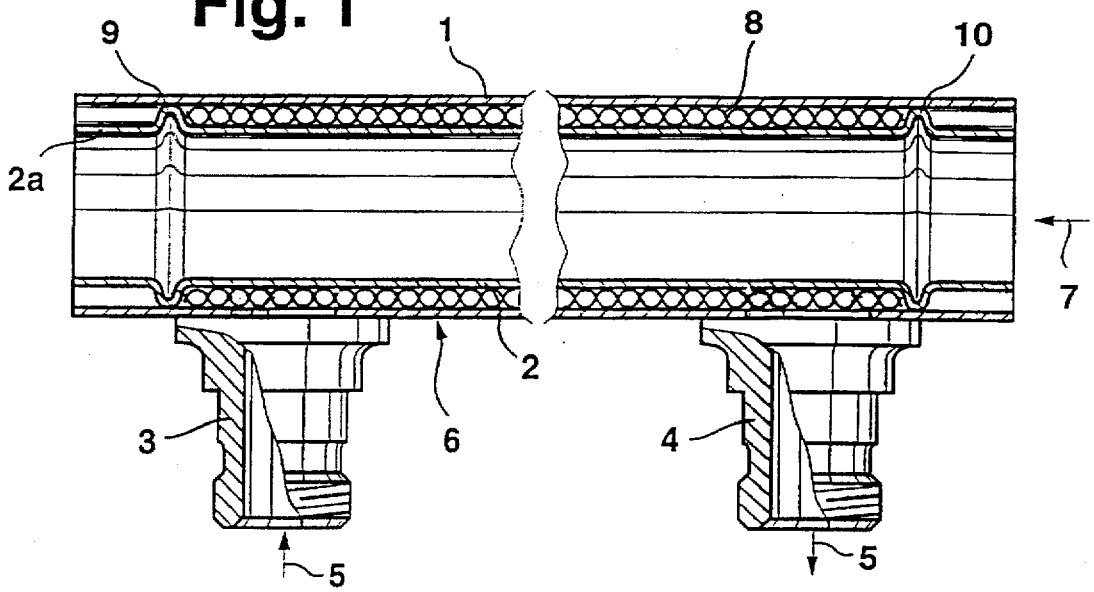
FIG. 1 is a part sectional view of a double-pipe heat exchanger constructed according to a first preferred embodiment of the invention.
Figure 2:
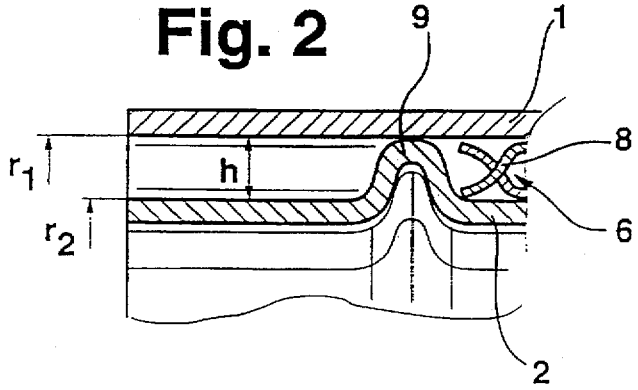
FIG. 2 is an enlarged representation of the left end of the heat exchanger assembly of FIG. 1.

FIG. 1 illustrates a double-pipe heat exchanger which is constructed as a double-pipe oil cooler and consists of an exterior pipe 1 and an interior pipe 2 which are each made of solder-plated aluminum. In this case, the pipes are made of a flat material bent after the plating into a pipe shape and joined by means of a longitudinal weld seam. In a manner known per se, in this case, two connection pieces 3 and 4 are fitted onto the exterior pipe, through which connection pieces 3 and 4 oil, for example, hot engine oil or transmission oil, is guided in the direction of the arrows 5 into a ring-shaped flow duct 6 between the exterior pipe and the interior pipe 1 and 2 which is to be cooled by means of a second heat exchange medium which in the embodiment shown is water guided through the interior pipe 2 and which enters pipe 2 in the direction of the arrow 7. In the ring-shaped flow duct 6 between the pipes 1 and 2, the oil flows through the inlet connection 3 and through an inlet opening, which is not shown in detail, in the pipe and leaves this flow duct through the outlet connection 4 and through an opening in the exterior pipe 1 which is also not shown in detail. The flow duct 6 is equipped with a turbulence insert 8 which is constructed in a known manner. The flow duct 6 is bounded to the outside by a surrounding bead-type collar 9 which, in the form of a surrounding bead (see also FIG. 2), is pressed out of the interior pipe 12 in the area of its left end 2*a*. In this case, the height (h) (FIG. 2) of this collar 9 corresponds to the difference of the radii ($r_1$) of the interior wall of the exterior pipe 1 and the radius ($r_2$) of the exterior wall of the interior pipe 2, in which case a play remains of a magnitude of 1/10–2/10 mm in order to easily permit the sliding of the pipes into one another during the mounting and to avoid a scraping-off of the fluxing agents or solder layer during this operation.

During the manufacturing of the double-pipe oil cooler of FIG. 1, first the interior pipe 2 is provided in the area of its two ends with the collars 9 and 10 pressed out in a bead-shape. The interior pipe 2 or the exterior pipe are then provided with fluxing agent and, after the arranging of the turbulence insert 8 between the collars 9 and 10, the exterior pipe 1 is slid on axially. As a rule, a widening of the interior pipe 2 will then also be provided in order to bring the turbulence plate 8 in the ring-shaped flow duct 6 into a solderable contact on the pipe walls. Subsequently, the thus produced arrangement is heated in the soldering furnace to the required temperature so that tight soldering joints are created in the area of the collars 9 and 10 and naturally also in the area of the fitted-on connection pieces 3 and 4. After the cooling, the double-pipe heat exchanger will be finished.

It is also contemplated to provide a turbulence insert 8, which is solder-plated on both sides, and the area of the flow duct only is provided with fluxing agent. In this case, only the exterior ring gaps of the pipes are then still brushed with fluxing agent. In this case, the solder required for achieving a tight double-pipe cooler (for the most part) comes from the corresponding solder-plated pipe.

Figure 3:
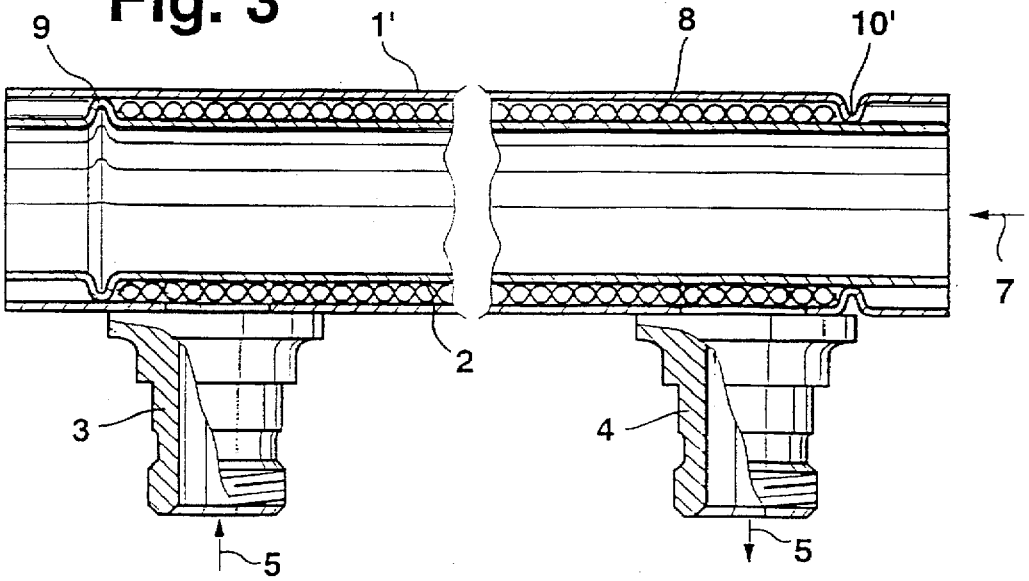
FIG. 3 is a view of a double-pipe heat exchanger constructed according to a second preferred embodiment of the invention.

FIG. 3 shows a modification in that, in this case, the exterior pipe 1' is provided in the area of its right end with a surrounding collar 10' which is pressed to the inside in the manner of a corrugation, while the interior pipe 2 is provided only on its left end with the outwardly directed collar 9. In this case, both collars 9 and 10' are dimensioned like the collar 9 and as described above so that, during the manufacturing, the turbulence insert 8 in a pipe shape can be slid onto the interior pipe 2 until it comes to rest against the collar 9. Subsequently, the exterior pipe 1' can be axially slid from the right to the left, that is, in the direction of the arrow 7 onto the interior pipe 2 and onto the turbulence insert 8 until the pipe ends are aligned. The soldering operation will then be carried out in the same manner as described above. This embodiment has the advantage that the turbulence insert can also be slid on axially so that a relatively easy mounting is possible.

Figure 4:
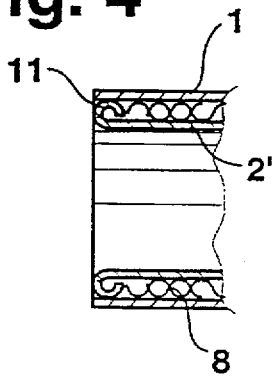
FIG. 4 is a representation of a detail of the left end of a double-pipe heat exchanger constructed according to a third preferred embodiment of the invention.

FIG. 4 shows a variant in that here a smooth exterior pipe 1 (as in FIG. 2) is provided but in that the interior pipe 2', on its left end, has a collar 11 which is roller-burnished toward the outside and whose dimensions correspond to those of the collar 9. Also by means of this roller-burnished collar 11, a contact and guiding of the exterior pipe 1 is achieved during the mounting. Simultaneously, this collar 11 is used as a sealing point after the soldering operation. Also in this embodiment, the interior pipe 2' can be provided on both ends with a collar 11 which is roller-burnished to the outside. The arrangement of only the shown left roller-burnished collar 11 is also contemplated, while the exterior pipe 1 has an inwardly roller-burnished collar on the right side so that a mounting as in FIG. 3 becomes possible. Finally, embodiments are also contemplated wherein it is provided that the exterior pipe 2 has inwardly roller-burnished collars, as is also possible in principle in the case of the embodiment according to FIG. 1 in a technical reversal in which the collars 9 and 10 do not extend from the interior pipe toward the outside but from the exterior pipe 1 toward the inside.

All embodiments ensure a simple mounting and are particularly suitable for the manufacturing of the double-pipe heat exchanger made of aluminum and for the soldered connection by means of the Nocolok process.

Figure 5:
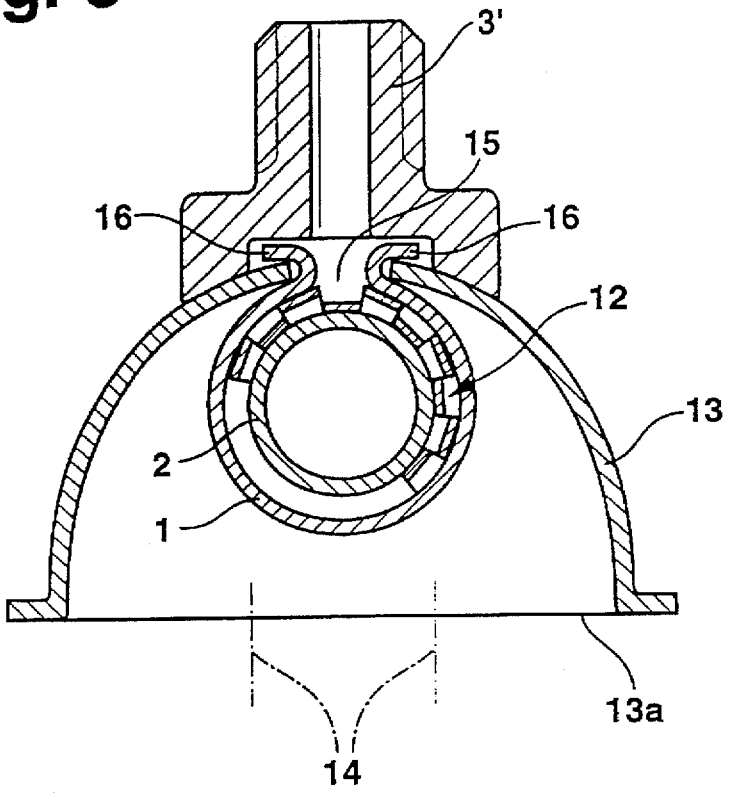
FIG. 5 is a view of double-pipe cooler according to the invention integrated into the collector tank of a radiator of a motor vehicle engine.
Figure 6:
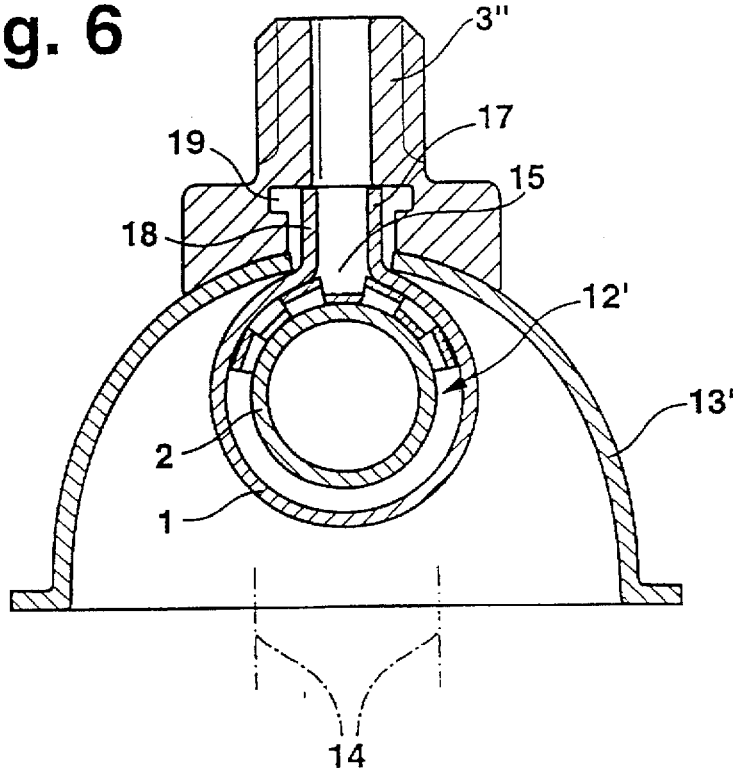
FIG. 6 is a view of a variant of a double-pipe cooler installed into a collecting tank according to FIG. 5.

FIGS. 5 and 6 illustrate an advantageous embodiment of the new double-pipe heat exchangers in that the double pipe heat exchangers are installed there as oil coolers directly in one of the collecting tanks of he radiator for the engine coolant.

For this purpose, in FIG. 5, a double-pipe cooler 12 according to the invention is installed directly in a collecting tank 13 of a coolant radiator for a motor vehicle engine which is not shown in detail because it is known. In this case, in a known manner, the collecting tank 13 is closed off from its lower end 13 by a pipe bottom which is not shown, and therefore, along the axes 14 of the pipes which lead into the pipe bottom but are also not shown, a flow takes place against the exterior pipe 1 of the double-pipe oil cooler 12. In the case of a suitable arrangement of the double-pipe cooler with respect to the inflow or return flow piece of the collecting tank 13, the flow of the coolant penetrates the interior space of the interior pipe 2.

In the illustrated embodiment, the exterior pipe 1 was provided on at least two points with an opening 15 and the edge of this bore was then pulled or drawn to the outside in the form of a collar by means of conventional devices and was flanged in the shape of the flanged edge 16 around an opening in the collecting tank 13. A connection piece 3' was the placed on the opening 15 in the exterior pipe 2 and in the collecting tank 13, which connection piece 3', like the flanged-around edge 16, is tightly soldered to the collecting tank 13.

For this purpose, in the case of the embodiment shown, the collecting tank 13 also consists of a solder-plated aluminum so that it is sufficient for the manufacturing to apply the suitable fluxing medium in the area of the edge 16 and in the area of the fitted-on cheeks of the connection 3' in order to establish by means of the Nocolok process, a complete tight soldered connection of the double-pipe cooler 12 (as also explained in the preceding figures) and the connection between this double-pipe cooler and the collecting tank 13 and its connection piece 3'. It is to be understood that in addition to the opening 15 with the connection piece 3', another opening not shown in FIG. 5 is assigned to the exterior pipe 1, which opening is fastened to the collecting tank 13 in the same manner and is soldered to it so that, as also in the embodiments of FIGS. 1 to 4, the oil to be cooled can be guided through the connection piece 3' into the space between the exterior pipe 1 and the interior pipe 2 and can be removed again through the connection piece which is not shown.

The advantage of the embodiment illustrated in FIG. 5 is that a cooler made only of aluminum can be provided by means of the double-pipe oil cooler on which no other materials are used so that an easy recycling is possible.

FIG. 6 shows an embodiment which is largely similar to that of FIG. 5. The only difference is that here the neck 17 of the double-pipe cooler 12', which is pulled or drawn from the opening 15 toward the outside, is not flanged around the edge of a corresponding opening in the collecting tank 13' but is pressed into a corresponding recess 18 of the connection piece 3". This neck 17 may also be pressed into the groove 19 inside the connection piece 3". Since the whole radiator including the double-pipe cooler consists of aluminum, this embodiment also permits a perfect recycling.

The collecting tank 13 may either—as illustrated in FIGS. 5 and 6—have a half-shell-shaped construction or may be soldered to an additional metal bottom or may be produced in one piece from a solder-plated pipe or from two half-shells which are soldered together.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Double-pipe heat exchanger comprising:

an exterior pipe, and an interior pipe coaxially fitted into the exterior pipe to thereby form an annular flow duct between the exterior pipe and the interior pipe, wherein at least one circumferentially extending bead-type collar is formed from material of one of said pipes, said collar having a radial dimension which corresponds substantially to a difference in radii of an interior wall of the exterior pipe and an exterior wall of the interior pipe, wherein said bead-type collar of said one pipe is soldered to the other of said pipes to form a fluid tight closure of said annular flow duct, and wherein each bead type collar is pressed out of material of one of the pipes in the manner of a surrounding corrugation just in front an end of the pipes.

2. Double-pipe heat exchanger according to claim 1, wherein two of said bead type collars are provided, disposed at respective opposite axial ends of said annular flow duct.

3. Double-pipe heat exchanger according to claim 1, wherein a turbulence insert is disposed in said annular flow duct.

4. Double-pipe heat exchanger according to claim 3, wherein said turbulence insert is soldered to said pipes.

5. Double-pipe heat exchanger according to claim 1, wherein each pipe is provided with one of said bead type collars.

6. Double-pipe heat exchanger according to claim 1, wherein one of said pipes has a smooth construction and the other pipe is constructed with one collar respectively on its two ends.

7. Double-pipe heat exchanger according to claim 6, wherein each pipe is provided with one of said bead type collars.

8. Double-pipe heat exchanger according to claim 3, wherein one of said pipes has a smooth construction and the other pipe is constructed with one collar respectively on its two ends.

9. Double-pipe heat exchanger according to claim 8, wherein a turbulence insert of solder-plated aluminum is disposed in the annular flow duct and is soldered together with said pipes.

10. Double-pipe heat exchanger according to claim 1, wherein said pipes are made of aluminum.

11. Double-pipe heat exchanger according to claim 4, wherein said pipes are made of aluminum.

12. Double-pipe heat exchanger according to claim 2, comprising at least one inflow or outflow opening with a neck in the exterior pipe, which neck is pressed around said opening from the material of the exterior pipe toward the outside, which neck is slid into an opening of a collecting tank of an engine radiator and is tightly soldered to it.

13. Double-pipe heat exchanger according to claim 12, wherein the neck is flanged around an edge of the opening in the collecting tank and is surrounded by a connection piece.

14. Double-pipe heat exchanger according to claim 12, wherein the neck is pressed into a corresponding recess of a connection piece and is soldered to the connection piece.

15. Double-pipe heat exchanger according to claim 12, wherein solder-plated aluminum is used as the material for the manufacturing of the collection tank.

16. Double-pipe heat exchanger according to claim 13, wherein the connection piece consists of aluminum and is soldered in one operation by means of the Nocolok process to the collecting tank and the double-pipe heat exchanger.

17. Double-pipe heat exchanger according to claim 1, wherein said pipes are formed of solder-plated aluminum.

18. Double-type heat exchanger according to claim 2, wherein said pipes are formed of solder-plated aluminum.

19. Double-type heat exchanger according to claim 3, wherein said pipes are formed of solder-plated aluminum.

20. Double-type heat exchanger according to claim 5, wherein said pipes are formed of solder-plated aluminum.

21. Double-type heat exchanger according to claim 6, wherein said pipes are formed of solder-plated aluminum.

22. Double-pipe heat exchanger comprising:

an exterior pipe, and an interior pipe coaxially fitted into the exterior pipe to thereby form an annular flow duct between the exterior pipe and the interior pipe, wherein at least one circumferentially extending bead-type collar is formed from material of one of said pipes, said collar having a radial dimension which corresponds substantially to a difference in radii of an interior wall of the exterior pipe and an exterior wall of the interior pipe, wherein said pipes are formed of solder-plated aluminum and said bead-type collar of said one pipe is soldered to the other of said pipes to form a fluid tight closure of said annular flow duct, wherein two of said bead type collars are provided, disposed at respective opposite axial ends of said annular flow duct, and comprising at least one inflow or outflow opening with a neck in the exterior pipe, which neck is pressed around said opening from the material of the exterior pipe toward the outside, which neck is slid into an opening of a collecting tank of an engine radiator and is tightly soldered to it.

23. Double-pipe heat exchanger according to claim 22, wherein the neck is flanged around an edge of the opening in the collecting tank and is surrounded by a connection piece.

24. Double-pipe heat exchanger according to claim 22, wherein the neck is pressed into a corresponding recess of a connection piece and is soldered to the connection piece.

25. Double-pipe heat exchanger according to claim 22, wherein solder-plated aluminum is used as the material for the manufacturing of the collection tank.

26. Double-pipe heat exchanger according to claim 23, wherein the neck is flanged around an edge of the opening in the collecting tank and is surrounded by a connection piece.

* * * * *